United States Patent [19]

Lapart

[11] 4,456,894

[45] Jun. 26, 1984

[54] DISTRIBUTED-CONSTANT RESISTANCE FOR USE AS A HIGH DISSIPATION LOAD AT HYPERFREQUENCIES

[75] Inventor: Gérard Lapart, Fontenay-sous-Bois, France

[73] Assignee: Les Cables de Lyon, Clichy, France

[21] Appl. No.: 485,364

[22] Filed: Apr. 15, 1983

[30] Foreign Application Priority Data

Apr. 16, 1982 [FR] France ..... 82 06559

[51] Int. Cl.[3] ..... H01P 1/26

[52] U.S. Cl. ..... 333/22 R; 333/81 A; 338/217; 338/308

[58] Field of Search ..... 333/22 R, 81 R, 81 A, 333/238; 338/217, 307, 308, 309; 219/543

[56] References Cited

U.S. PATENT DOCUMENTS

| | | | |
|---|---|---|---|
| 2,459,857 | 1/1949 | Watts, Jr. | 338/217 X |
| 3,678,417 | 7/1972 | Ragan et al. | 333/22 R |
| 4,126,824 | 11/1978 | Thornburg et al. | 338/217 X |
| 4,310,812 | 1/1982 | De Bloois | 333/81 A |

FOREIGN PATENT DOCUMENTS

| | | |
|---|---|---|
| 44758 | 1/1982 | European Pat. Off. . |
| 40567 | 11/1982 | European Pat. Off. . |
| 2286548 | 4/1976 | France . |
| 2061048 | 5/1981 | United Kingdom . |

*Primary Examiner*—Volodymyr Y. Mayewsky
*Attorney, Agent, or Firm*—Sughrue, Mion, Zinn, Macpeak and Seas

[57] ABSTRACT

Conventional attenuators and matched loads for dissipating power at hyperfrequencies are uniform structures giving constant attenuation per unit length. This results in most power being dissipated at an input end. The present invention increases the maximum total power that such a resistance can dissipate by providing a non-uniform structure in which dissipation per unit length increases when going away from an input end, in such a manner that power is dissipated in a substantially uniform manner throughout the structure. A series resistance (3) between two parallel resistances (4 and 5) are in the shape of a sector of a circle.

8 Claims, 6 Drawing Figures

DISTRIBUTED-CONSTANT RESISTANCE FOR USE AS A HIGH DISSIPATION LOAD AT HYPERFREQUENCIES

The present invention relates to distributed constant resistances for use as high dissipation attenuators or matched loads at hyperfrequencies, eg. at up to 10 Ghz.

BACKGROUND OF THE INVENTION

The equivalent electrical circuits of two prior art resistive loads are shown in FIGS. 1 and 2. FIG. 1 shows an asymmetrical configuration of cells while FIG. 2 shows a symmetrical configuration. They comprise lumped series resistance values R1 in both cases and lumped parallel resistance values R2 in the asymmetrical case and 2R2 in the symmetrical case. In either case the iterative impedance of each cell is equal to $\sqrt{R1R2}$ and the attenuation is proportional to R1 and inversely proportional to R2. At hyperfrequencies it is the practice to use microstrips for making distributed-constant resitances. FIG. 3 shows a resistive strip of width W deposited on one face of a dielectric substrate whose other face is covered in a layer of conductive metal. The dielectric has a thickness h and a relative dielectric constant $\epsilon$. In this embodiment the resistance of the resistive layer per unit area is proportinal to the area. The resitive layer may be made from series 1610 material sold by Dupont and Nemours and which can be made to have a resistance of 10 ohms to one megohm for a standard sample which is 5 mm long by 2.5 mm wide by 25 micrometers thick (before baking). The characteristic impedance of the attenuation circuit is proportional to the logarithm of the ratio of the dielectric thickness h by the width W of the strip, and inversely proportional to the square root of the relative permitivity $\epsilon$. Thus between the attenuator's input E and its output S there is a distributed-constant series resistance R1 sandwiched between two distributed-constant parallel resistances 2R2. Up till now, the resistance R1 has been rectangular in shape and of low resistivity, while the resistances 2R2 have been likewise rectangular in shape but of very high resistivity, at least for low attenuation. Two return conductors are placed on the top face of the substrate to make a connection over the edge of the substrate to the metal layer on the other face.

The FIG. 3 prior art configuration gives rise to a constant characteristic impedance and a constant coefficient of attenuation per unit length since the series resistance R1 and the parallel resistances 2R2 are themselves uniform. As a result of the attenuation per unit length being constant from the input E to the output S, the power dissipated in successive sections of equal length along the attenuator is far from equal in a conventional attentuator and decreases from a maximum at the input to a minimum at the output. Supposing that the attenuator is divided into equal sections 1 to n each having an attenuation coefficient k, the power dissipated in the n-th section, $Pd_n$ is given by the equation:

$$Pd_n = \frac{P_O}{k^{n-1}}\left(1 - \frac{1}{k}\right) \quad (1)$$

where $P_O$ is the input power.

The drawback of such a technique is that a hot point is created at the input to the attenuator, thereby limiting the maximum power which it can dissipate, long before the remainder of the attenuator is in danger of getting hot. Thus inefficient use is made of the substrate area.

Preferred embodiments of the present invention mitigate this drawback by spreading power dissipation more evenly over the available substrate area, thereby enabling more power to be dissipated for a given area of substrate.

SUMMARY OF THE INVENTION

The present invention provides a distributed-constant resistance for use as a high dissipation load at hyperfrequencies, the resistance comprising an insulation substrate having a return conductor covering one face thereof, and having on its other face a series resistance layer of low resistivity per unit area, and at least one parallel resistance layer of high resistivity per unit area connecting a corresponding side of the series reistance layer to a metalized region in contact, via the edge of the substrate, with the return conductor, the improvement wherein the series resistance layer tapers in the form of a sector of a circle from a broad end having a metal contact for receiving input power to a narrow end, and wherein said parallel resistance likewise tapers in the form of a sector of a circle from a broad end to a narrow end, with the series resistance and the parallel resistance being in contact along a common radius and with respective broad ends being adjacent to one another and respective narrow ends being adjacent to one another.

Preferably the series resistance has increasing resistance per unit length going away from the input, and the parallel resistance has decreasing resistance per unit length going away from the input, whereby the attenuation coefficient per unit length increases smoothly going away from the input such that power is dissipated uniformly per unit area of the resistance layers.

One embodiment of the invention comprises an attenuator having an output in the form of a metal contact to the narrow end of said series resistance close to the geometric center of the sector of a circle that it constitutes.

Another embodiment of the invention comprises a matched load, in which the respective series and parallel resistance sectors extend on the sustrate to the centers of their circles.

BRIEF DESCRIPTION OF THE DRAWINGS

An embodiment of the present invention is described by way of example with reference to the accompanying drawings, in which.

MORE DETAILED DESCRIPTION

Figure 4:
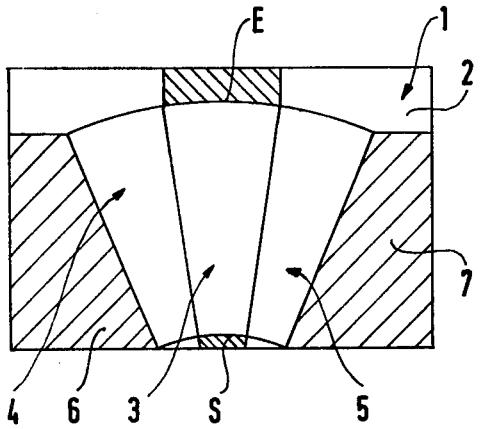
FIG. 4 is a diagrammatic plan view of an attenuator in acordance with the invention made from distributed constant resistive layers having an increasing attenuation coefficient.

FIG. 4 shows an attenuator 1 comprising an insulating substrate 2 of aluminum oxide ($Al_2O_3$) or berylium oxide (BeO) for example, and covered on its bottom face (not visible in the figure) by a metal return conductor plate. On its top face, as seen in the figure, there is an attenuator input E, an attenuator output S, a series resistive layer 3 in the shape of a sector of a circle interconnecting said input and output, two parallel resistive layers 4 and 5 in the shape of adjacent sectors flanking the series layer 3, and two conductive layers 6 and 7 flanking the parallel layers 4 and 5 and connecting them round the edges of the substrate to the return conductor plate on the bottom face thereof.

Figure 5:
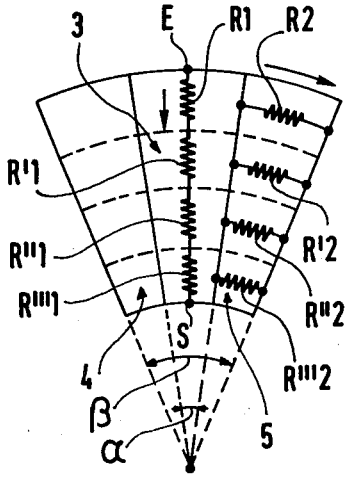
FIG. 5 is a lumped constant circuit diagram for the FIG. 4 attenuator.

The resistive layers comprise, in known manner, a mixture of ruthenium oxide, an organic binder, and a quantity of glass particles that varies with desired resistivity. The series layer 3 must have low resistivity, eg. 10 ohms for a sample which is 5 mm long, 2.5 mm wide and 25 micrometers thick (before baking). The layer 3 is equivalent to a series resistor R1, except that since it is made from distributed material, as can be seen in FIG. 5, its resistance increases from the input E to the output S of the attenuator. By taking four radially successive cells of equal radial extent and having respective series resistances of R1, R'1, R''1, and R'''1, when going from the input E to the output S, we have:

$$R1<R'1<R''1<R'''1 \quad (2)$$

This is because the resistance of each cell is proportional to the length of the resistive cell conductor in the radial direction (all equal in this case) and inversely proportional to the cell width which decreases progressively going from the input E to the output S.

The apex angle $\alpha$ of the sector 3 may be about half a radian.

Figure 1:
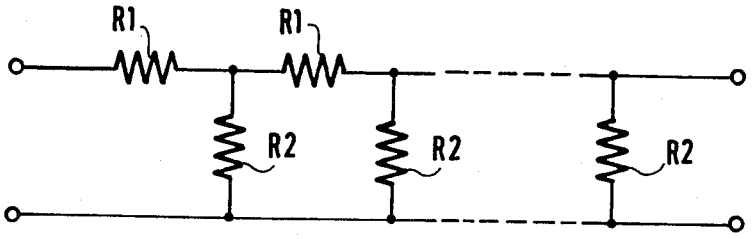
FIG. 1 (PRIOR ART)
FIG. 1 is a circuit diagram of a prior art arrangement of lumped resistances in asymmetrical cells.
Figure 2:
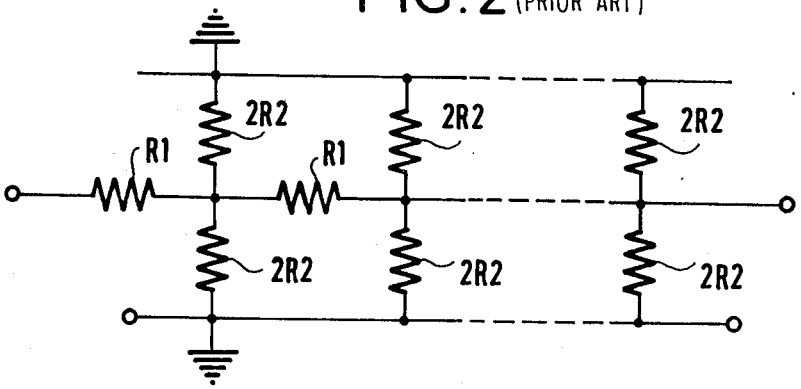
FIG. 2 (PRIOR ART)
FIG. 2 is a circuit diagram of a prior art arrangement of lumped resistances in symmetrical cells.

On either side of the series resistor 3 there is a parallel reistor 4 or 5, giving an equivalent circuit as shown in FIG. 2. (In an alternative configuration there could be only one flanking parallel resistor 4, in which cases the equivalent circuit would be similar to the one shown in FIG. 1). The resistive layers 4 and/or 5 may be applied to the substrate by silk screen printing for example. These parallel resistors R2 should have high resistivity, eg. 1 kohm for a sample which is 5 mm long by 2.5 mm wide and 25 micrometers thick before baking. By taking the same four radially successive cells of equal radial extent and having respective parallel resistances of R2, R'2, R''2, and R'''2, when going from the input E to the output S (see FIG. 5), we have:

$$R2>R'2>R''2>R'''2 \quad (3)$$

This is because, in each cell, parallel resistance is proportional to the tangential length of the cell which decreases progressively when going from the input E to the output S, and is proportional to the radial width of the cell which is constant. The apex angle $\beta$ of the three sectors 3, 4 and 5 taken together may be about 2.5 radians.

The attenuator input E and output S, the return paths 6 and 7 and the metal plate on the bottom face of the substrate are all made from a metal such as gold, or an alloy of silver and palladium.

The coefficient of attenuation k is proportional to the ratio R1/R2, and therefore increases progressively when going from the input E to the output S. This can be seen clearly by comparing the inequalities (2) and (3). Further, the iterative impedance remains generally constant since it is proportional to the product R1R2.

Figure 3:
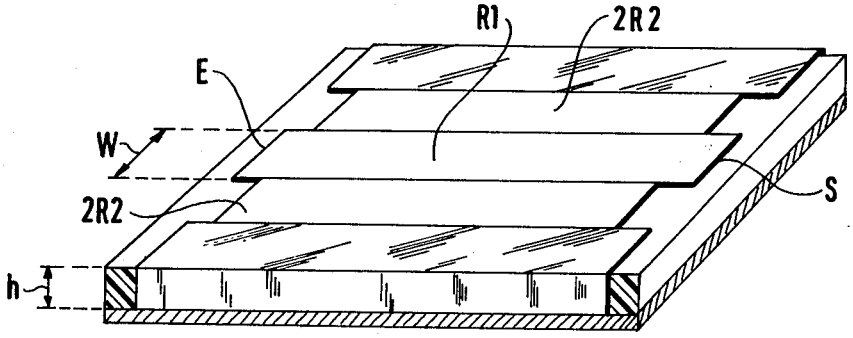
FIG. 3 (PRIOR ART)
FIG. 3 is a diagrammatic perspective view of a prior art attenuator made from distributed constant resistive layers having a constant attenuation coefficient.

Since the power dissipated in the n-th cell, $Pd_n$ is given by the equation:

$$Pd_n = \frac{Po}{k_1 k_2 k_{n-1}}\left(1 - \frac{1}{k_n}\right)$$

and since the coefficients $K_1 \ldots k_{n-1}$ when multiplied together are less than the coefficient $k^{n-1}$ appropriate to FIG. 3 (see equation (1)), it follows that the power dissipated in the n-th cell of an attenuator in accordance with the invention is greater than the power disspated in the n-th cell of a prior art attenuator.

It is thus possible to arrange for heat to be dissipated in a uniform manner over the entire surface area of the resistive layers.

The power at the output may be 30 dB down on the power at the input of the attenuator, while its characteristic impedance may be matched to 50 ohms.

Figure 6:
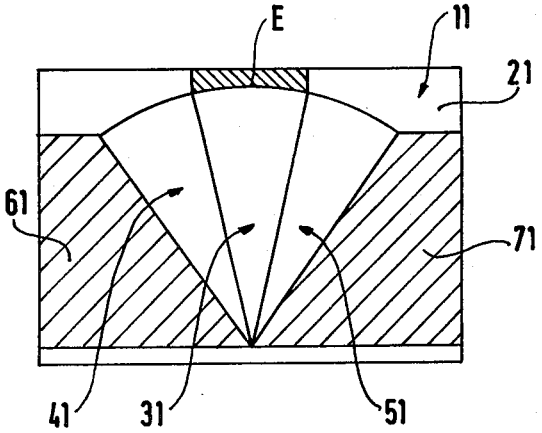
FIG. 6 is a diagrammatic plan view of a matched load in accordance with the invention made from distributed constant resistive layers having an increasing attenuation constant.

FIG. 6 shows a matched load 11 applying the same principle and made in the same manner as the attenuator 1 using a series layer 31 and one or two parallel layers 41 and 51 surrounded by return conductors 61 and 71. An input E is provided to receive microwave power at a characteristic impedance of 50 ohms, for example. Since no outlet is required, the sector shaped members 31, 41 and 51 may extend as far as their geometrical center on the substrate 21. A load 11 of this design can dissipate 600 watts on an area of 2.5 cm×2.5 cm (ie. about one inch square).

The invention is particularly appicable to attenuators and to matched loads for use at frequencies in the range 1 to 10 GHz.

I claim:

1. A distributed-constant resistance for use as a high dissipation load at hyperfrequencies; said resistance comprising; an insulating substrate having opposed faces, and an edge, a return conductor covering one of said faces, a series resistance layer of low resistivity per unit area on the other of said faces, and at least one parallel resistance layer of high resistivity per unit area connecting a corresponding side of the series resistance layer to a metalized region in contact, via said edge of the substrate, with the return conductor, the improvement wherein the series resistance layer tapers in the form of a sector of a circle from a broad end and having a metal contact connected thereto for receiving input power to a narrow end, and wherein said parallel resistance likewise tapers in the form of a sector of a circle from a broad end to a narrow end, with the series resistance and the paralled resistance being in contact along a common radius and with respective broad ends being adjacent to one another and respective narrow ends being adjacent to one another.

2. A resistance according to claim 1, wherein the series resistance has increasing resistance per unit length going away from the input, and the parallel resistance has decreasing resistance per unit length going away from the input, whereby the attenuation coefficient per unit length increases smoothly going away from the input such that power is dissipated uniformly per unit area of the resistance layers.

3. A resistance according to claim 1, acting as an attenuator and including an output in the form of a metal contact connected to the narrow end of said series resistance close to the geometric center of the sector of a circle that it constitues.

4. A resistance according to claim 1, defining a matched load, wherein the respective series and parallel resistance sectors extend on the substrate to the centers of their circles.

5. A resistance according to claim 1, wherein the metal contacts are made of a metal chosen from gold and an alloy of silver and palladium.

6. A resistance according to claim 1, wherein the substrate is made of one material chosen from the group consisting of aluminum oxide and berylium oxide.

7. A resistance according to claim 1, wherein the series resistance layer is a sector having an apex angle of about half a radian.

8. A resistance according to claim 1, wherein the series resistance layer and said at least one adjacent parallel resistance layer together constitute a sector having an apex angle of about two and a half radians.

* * * * *